US010431161B2

(12) United States Patent
Tamura

(10) Patent No.: US 10,431,161 B2
(45) Date of Patent: Oct. 1, 2019

(54) DISPLAY DEVICE AND ELECTRONIC APPARATUS HAVING ANALYSIS CIRCUIT ANALYZING GRADATION DATA

(71) Applicant: SEIKO EPSON CORPORATION, Tokyo (JP)

(72) Inventor: Tsuyoshi Tamura, Hara-mura (JP)

(73) Assignee: SEIKO EPSON CORPORATION, Tokyo (JP)

( * ) Notice: Subject to any disclaimer, the term of this patent is extended or adjusted under 35 U.S.C. 154(b) by 166 days.

(21) Appl. No.: 15/433,224

(22) Filed: Feb. 15, 2017

(65) Prior Publication Data

US 2017/0249885 A1 Aug. 31, 2017

(30) Foreign Application Priority Data

Feb. 25, 2016 (JP) ..... 2016-034098

(51) Int. Cl.
*G09G 3/3283* (2016.01)
*G09G 3/20* (2006.01)

(52) U.S. Cl.
CPC ..... *G09G 3/3283* (2013.01); *G09G 3/2003* (2013.01); *G09G 2300/0828* (2013.01); *G09G 2310/027* (2013.01); *G09G 2310/0272* (2013.01); *G09G 2310/0294* (2013.01); *G09G 2320/0238* (2013.01); *G09G 2320/0626* (2013.01); *G09G 2330/023* (2013.01)

(58) Field of Classification Search
CPC ..... G09G 3/12; G09G 3/14; G09G 3/2085; G09G 3/32–3208; G09G 3/3225–325; G09G 3/3275–3291; G09G 2300/0804; G09G 2300/0828–0838; G09G 2310/0213; G09G 2310/027; G09G 2310/0272; G09G 2310/0286–0297; G09G 2320/0626; G09G 2330/02–023; G09G 2330/028; G09G 2360/16
See application file for complete search history.

(56) References Cited

U.S. PATENT DOCUMENTS 5,537,650 A * 7/1996 West ..... G09G 3/3611 713/324
2003/0184568 A1* 10/2003 Date ..... G09G 3/3685 345/690

(Continued)

FOREIGN PATENT DOCUMENTS

JP 2006-313189 A 11/2006
JP 2007-333996 A 12/2007

(Continued)

*Primary Examiner* — Nathan Danielsen
(74) *Attorney, Agent, or Firm* — Oliff PLC

(57) ABSTRACT

A display device includes a plurality of latch circuits which latch gradation data that is used to drive a plurality of data lines, a plurality of D/A converters which convert gradation data that is latched to the plurality of latch circuits to a plurality of analog signals, a plurality of amplifiers which generate a plurality of gradation signals by respectively amplifying the plurality of analog signals output from the plurality of D/A converters, and an analysis circuit that analyzes gradation data that is latched to the plurality of latch circuits and reduces direct current that flows in at least one amplifier or at least one D/A converter according to an analysis result.

18 Claims, 7 Drawing Sheets

(56) References Cited

U.S. PATENT DOCUMENTS

| | | | | |
|---|---|---|---|---|
| 2004/0174329 | A1* | 9/2004 | Yamada | G09G 3/3688 345/89 |
| 2008/0150970 | A1 | 6/2008 | Ozawa et al. | |
| 2014/0285405 | A1 | 9/2014 | Nomura | |
| 2016/0042681 | A1 | 2/2016 | Tamura et al. | |

FOREIGN PATENT DOCUMENTS

| | | | |
|---|---|---|---|
| JP | 2008-158401 | A | 7/2008 |
| JP | 2008-170824 | A | 7/2008 |
| JP | 2011-013275 | A | 1/2011 |
| JP | 2013-160872 | A | 8/2013 |
| JP | 2013-190513 | A | 9/2013 |
| JP | 2014-186083 | A | 10/2014 |
| JP | 2014-186084 | A | 10/2014 |
| JP | 2014-186125 | A | 10/2014 |
| JP | 2015-114399 | A | 6/2015 |

* cited by examiner

DISPLAY DEVICE AND ELECTRONIC APPARATUS HAVING ANALYSIS CIRCUIT ANALYZING GRADATION DATA

BACKGROUND

1. Technical Field

The present invention relates to a display device that uses a display panel such as an organic electro-luminescence (EL) panel. Furthermore, the invention relates to an electronic apparatus and the like which is provided with such a display device.

2. Related Art

In recent years, various display panels are suggested that use a light emitting element such as an organic light emitting diode (hereinafter referred to as OLED). In such a display panel, a pixel circuit including a light emitting element, a transistor, and the like is provided corresponding to a position of a pixel at which a scanning line and a data line intersect. In addition, a display device (Si-OLED) has also been developed in which a driving circuit and the like are mounted in a silicon backplane of the display panel.

In the Si-OLED, a plurality of latch circuits, a plurality of digital/analog converters (DAC), a plurality of amplifiers, and the like are mounted on a silicon chip which configures the silicon backplane. Gradation data for one line that is latched to the plurality of latch circuits is converted to a plurality of analog signals using the plurality of DAC, and furthermore, a plurality of gradation signals are generated by amplifying using the plurality of amplifiers. The gradation signals are used to drive a plurality of data lines on the display panel.

In addition, the plurality (approximately 3 to 18) of data lines are driven by time division using one amplifier. The driving method is referred to as a demultiplexing driving method. According to the demultiplexing driving method, it is possible to reduce the number of DAC and amplifiers in comparison to a case where the DAC and amplifiers are provided on each data line.

As the related art, the display device using the demultiplexing driving method is disclosed in JP-A-2014-186083 (paragraph [0038], FIGS. 1 and 3). FIG. 3 in JP-A-2014-186083 (paragraph [0038], FIGS. 1 and 3) indicates a demultiplexer block 41 which switchably outputs a data potential by time division in M×3 (RGB) pixels on one line of a display portion 100 in FIG. 1. For example, in a case where M=18, the demultiplexer block 41 indicated in FIG. 3 is provided only in a number equivalent to (all pixel numbers in a row direction) divided by 54.

However, even using the demultiplexing driving method, current consumption is large in the plurality of DAC and the plurality of amplifiers. In an all black display period, current does not flow in the light emitting element, but for example, current of approximately 28 mA flows in the driving circuit, and therein, current of approximately 16 mA flows in the amplifier.

SUMMARY

Therefore, a first advantage of some aspects of the invention is to reduce current consumption of the amplifier or a D/A converter in the driving circuit imparting almost no influence on image quality in the display device in which the driving circuit and the like are mounted on the silicon backplane of the display panel. In addition, a second advantage of some aspects of the invention is to provide an electronic apparatus and the like which are provided with such a display device.

According to a first aspect of the invention, there is provided a display device in which at least a display portion and a driving circuit are mounted on the same substrate, the display device including a plurality of latch circuits which latch gradation data that is used to drive a plurality of data lines provided corresponding to a plurality of columns of a pixel circuit in the display portion, a plurality of D/A converters which convert the gradation data that is latched to the plurality of latch circuits to a plurality of analog signals, a plurality of amplifiers which generate a plurality of gradation signals by respectively amplifying the plurality of analog signals output from the plurality of D/A converters, and an analysis circuit that analyses the gradation data that is latched to the plurality of latch circuits and reduces direct current that flows in at least one amplifier or at least one D/A converter according to an analysis result.

According to the first aspect of the invention, since the gradation data that is latched to the plurality of latch circuits is analyzed and direct current that flows in at least one amplifier or at least one D/A converter is reduced according to the analysis result, it is possible to reduce current consumption of the amplifier or the D/A converter in the driving circuit imparting almost no influence on image quality.

Here, in a case where the analysis circuit determines whether or not a gradation level of gradation data for one line that is latched to the plurality of latch circuits is a predetermined level or less and the gradation level of all pixels of one line is a predetermined level or less, the direct current that flows in the plurality of amplifiers or the plurality of D/A converters may be reduced in a period in which the pixel circuit of one line is driven based on the gradation data for one line.

In a case where the gradation level of all pixels in one line is a predetermined level or less, since the gradation level of the pixels is a black level or a low brightness level close to the black level, display unevenness and the like is difficult to visually recognize. Accordingly, it is possible to reduce the current consumption of the plurality of amplifiers or the plurality of D/A converters imparting almost no influence on image quality.

In that case, when the analysis circuit reduces the direct current which flows in the plurality of amplifiers, potential of the plurality of data lines may be controlled such that a driving transistor of the pixel circuit of one line that is driven based on the gradation data for one line is in a non-conductive state. Thereby, even if the direct current which flows in the plurality of amplifiers is reduced, it is possible to stop light emission by a light-emitting element of the pixel circuit of one line that is driven based on the gradation data for one line.

In the display device according to the first aspect of the invention, each of the plurality of D/A converters may sequentially convert gradation data for one block to an analog signal for one block in a case where the plurality of data lines are separately driven in a plurality of blocks, each of the plurality of amplifiers may amplify the analog signal for one block sequentially output from the respective D/A converters and generate a gradation signal for one block, and a plurality of demultiplexers to which gradation signals for a plurality of blocks output from the plurality of amplifiers are respectively supplied and which performs a switching operation such that the gradation signal for each block is supplied to the predetermined number of data lines by time division, may be further included. Thereby, it is possible to reduce the number of D/A converters and amplifiers in comparison to a case where the D/A converters and amplifiers are provided on each data line.

In this case, in a case where the analysis circuit determines whether or not a gradation level of gradation data for one block that is latched to the plurality of latch circuits is a predetermined level or less and the gradation level of all pixels of one block is a predetermined level or less, the direct current that flows in the amplifiers that are connected to the D/A converters to which the gradation data for one block is supplied may be reduced in a period in which the pixel circuit of one block is driven based on the gradation data for one block.

In a case where the gradation level of all pixels in one block is a predetermined level or less, since the gradation level of the pixels is a black level or a low brightness level close to the black level, display unevenness and the like is difficult to visually recognize. Accordingly, it is possible to reduce the current consumption of the amplifiers that are connected to the D/A converters to which gradation data for one block is supplied imparting almost no influence on image quality.

Alternatively, in a case where the analysis circuit determines whether or not a value of gradation data for one pixel that is supplied to each of the plurality of D/A converters is zero and the value of gradation data for one pixel is zero, the direct current that flows in the amplifiers that are connected to the D/A converters to which the gradation data for one pixel is supplied may be reduced in a period in which one pixel circuit is driven based on the gradation data for one pixel.

In a case where the value of gradation data for one pixel is zero, it is not necessary for the light-emitting element of the pixel circuit of the pixel to emit light. Accordingly, it is possible to reduce the current consumption of the amplifiers that are connected to the D/A converters to which gradation data for one pixel is supplied imparting almost no influence on image quality.

Furthermore, when the analysis circuit reduces direct current that flows in the amplifier, an output terminal of the amplifier may be pulled up to a maximum potential of the gradation signal. Thereby, even if the direct current which flows in the amplifier is reduced, it is possible to stop light emission by the light-emitting element of the pixel circuit corresponding to the amplifier.

Above, in a case where the analysis circuit determines whether or not a gradation level of gradation data for one line that is latched to the plurality of latch circuits is a predetermined level or more and the gradation level of all pixels of one line is a predetermined level or more, the direct current that flows in the plurality of amplifiers or the plurality of D/A converters may be reduced in a period in which the pixel circuit of the one line is driven based on the gradation data for one line.

In a case where the gradation level of all pixels in one line is a predetermined level or more, since the gradation level of the pixels is a white level or a high brightness level close to the white level, display unevenness and the like is difficult to visually recognize. Accordingly, it is possible to reduce the current consumption of the plurality of amplifiers or the plurality of D/A converters imparting almost no influence on image quality.

In addition, the analysis circuit may reduce direct current that flows in the plurality of D/A converters in a blanking period. Since the gradation level is not a problem in the blanking period, it is possible to reduce the current consumption of the plurality of D/A converters imparting no influence on image quality.

According to a second aspect of the invention, there is provided an electronic apparatus including any display device described above. According to the second aspect of the invention, it is possible to reduce current consumption of the electronic apparatus using the display device in which current consumption of the amplifier or the D/A converter is reduced in the driving circuit imparting almost no influence on image quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
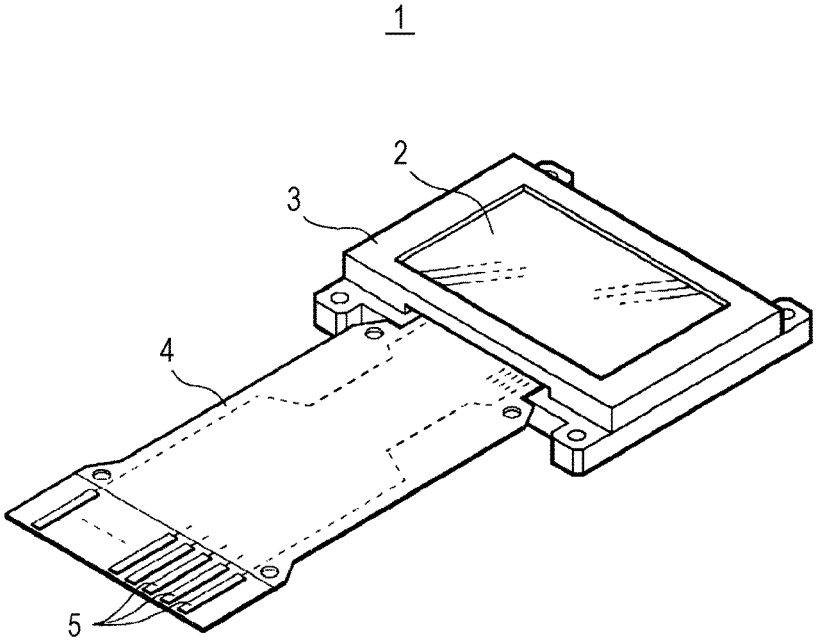
FIG. 1 is a perspective view illustrating a display device according to each embodiment of the invention.

An embodiment of the invention will be described below in detail with reference to the drawings. Note that, the same reference numerals are given in the same configuring elements and overlapping description is omitted.

Display Device

FIG. 1 is a perspective view illustrating an outer appearance of a display device according to each embodiment of the invention. For example, a display device 1 is a micro display that displays an image on a head mounted display.

As shown in FIG. 1, the display device 1 includes a display panel 2 of an organic EL panel and the like, a casing 3, and a flexible printed circuit (FPC) substrate 4. For example, the display panel 2 is accommodated in the casing 3 with a frame shape that forms an opening on a display portion, and is connected to the FPC substrate 4. A plurality of terminals 5 for connecting an external apparatus such as a host CPU (refer to FIG. 2) are provided on the FPC substrate 4.

The display panel 2 includes a plurality of active matrix system pixel circuits provided on a silicon backplane (silicon chip). Respective pixel circuits include a light-emitting element such as an OLED, a plurality of transistors, and the like. In addition, the driving circuit and the like which drives the pixel circuits are provided on the silicon backplane.

First Embodiment

Figure 2:
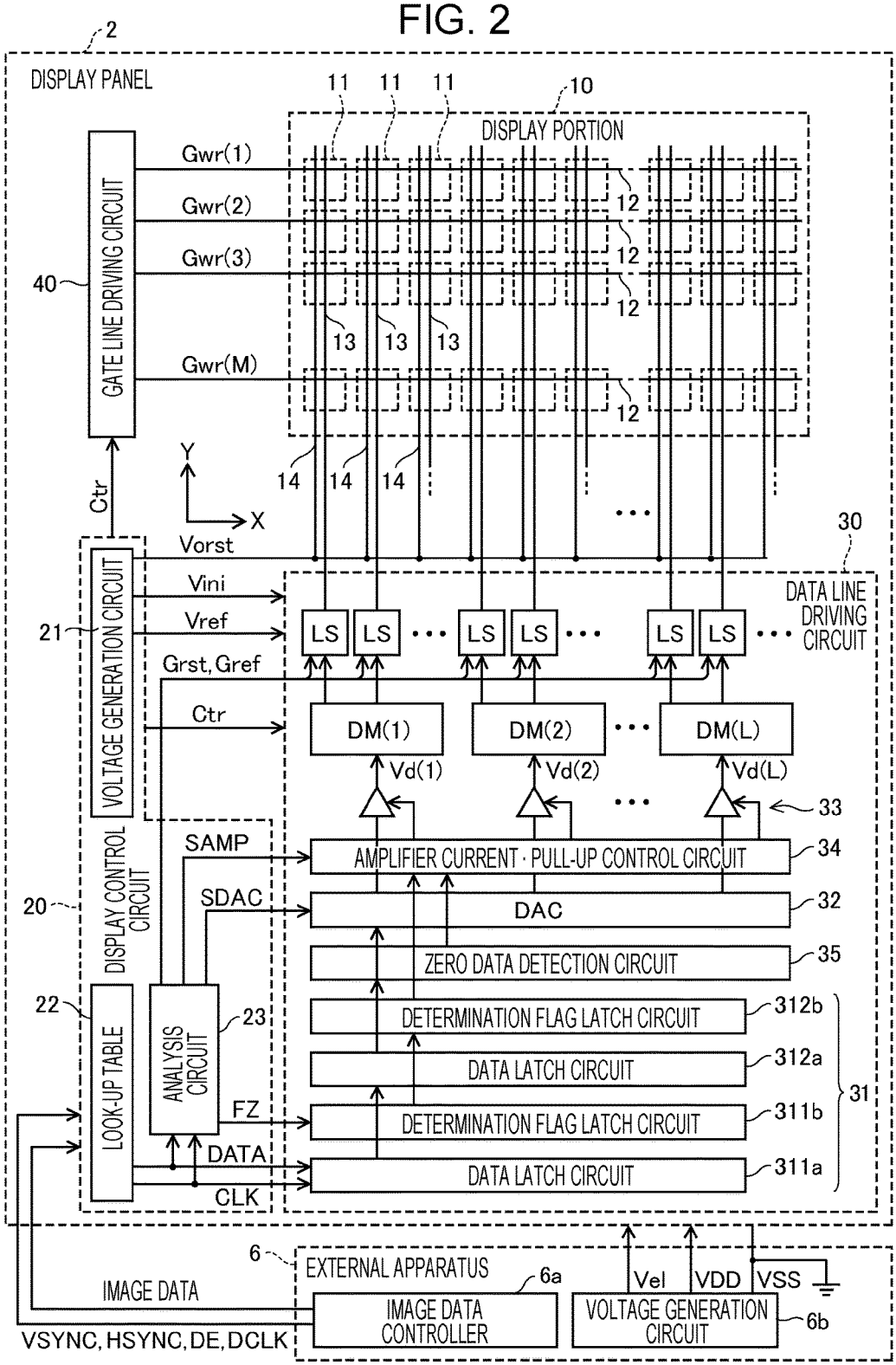
FIG. 2 is a block diagram illustrating a configuration example of the display device according to each embodiment of the invention.

FIG. 2 is a block diagram illustrating a configuration example of the display device according to each embodiment of the invention. The display panel 2 and the external apparatus 6 are indicated in FIG. 2. The display panel 2 includes a display portion 10, a display control circuit 20, data line driving circuit (source driver) 30, and a gate line driving circuit (gate driver) 40. The display control circuit 20 to the gate line driving circuit 40 are provided on the silicon backplane of the display panel 2.

The display portion 10 includes a plurality of pixel circuits 11. For example, the pixel circuit 11 of M rows×(3N) columns corresponding to three types of pixels (dots) of R (red), G (green), and B (blue) are arranged in a two-dimensional matrix shape (M and N are two or more integers).

In the display portion 10, M scanning lines 12 are provided extending in a first direction (X axis direction in the drawing) corresponding to M rows of the pixel circuit 11. In addition, (3N) data lines 13 are provided extending in a second direction (Y axis direction in the drawing) that is approximately orthogonal to the first direction corresponding to (3N) columns of the pixel circuit 11. Furthermore, (3N) data reset lines 14 are provided extending in the second direction corresponding to (3N) columns of the pixel circuit 11. A predetermined reset potential Vorst is supplied to each reset line 14.

For example, the display control circuit 20 is configured by a logic circuit and the like including a combined circuit or a sequential circuit, and controls a display timing in the display portion 10. Image data is supplied from an image data controller 6*a* of the external apparatus 6 to the display control circuit 20 in synchronization with a synchronization signal. The image data may be RGB format image data including color components of three colors of R (red), G (green), and B (blue) (for example, each color component is 8 bit). In addition, the synchronization signal may include a vertical synchronization signal VSYNC, a horizontal synchronization signal HSYNC, a data enabling signal DE, and a data clock signal DCLK.

The display control circuit 20 generates gradation data DATA based on the supplied image data, and gradation data DATA is supplied to the data line driving circuit 30 in synchronization with a clock signal CLK for internalization. For example, a look-up table 22 that is stored in association with brightness (gradation level) of the light-emitting element in the display portion 10 and gradation data DATA is provided in the display control circuit 20. The display control circuit 20 generates the gradation data DATA which corresponds to the gradation level represented by the supplied image data by referencing the look-up table 22.

In addition, the display control circuit 20 supplies a control signal Ctr which controls various timings to the data line driving circuit 30 and the gate line driving circuit 40. For example, the control signal Ctr may include the vertical signal, the horizontal signal, the data enabling signal or another control signal. The data line driving circuit 30 and the gate line driving circuit 40 displays an image on the display portion 10 based on the gradation data DATA, the control signal Ctr, and the like which are supplied from the display control circuit 20.

The display control circuit 20 further includes a voltage generation circuit 21 and an analysis circuit 23. The voltage generation circuit 21 generates various potentials and supplies the potentials to the data line driving circuit 30 and the like. For example, the voltage generation circuit 21 generates a reset potential Vorst, an initialization potential Vini supplied to a data line 13, a reference potential Vref that is applied to a capacitor C2 (refer to FIG. 4), and the like. A power source potential Vel on a high potential side, a logic power source potential VDD, and the like in the display portion 10, the data line driving circuit 30, and the gate line driving circuit 40 are supplied from a voltage generation circuit 6*b* of the external apparatus 6.

For example, the analysis circuit 23 is configured by the logic circuit and the like which include the combined circuit or the sequential circuit, analyzes the generated gradation data DATA, and it is possible to reduce direct current that flows in at least one amplifier 33 according to the analysis result. Therefore, the analysis circuit 23 generates a control signal SAMP which controls direct current in the amplifier 33.

The data line driving circuit 30 may include a plurality of latch circuits 31, a plurality of D/A converters (DAC) 32, a plurality of amplifiers 33, an amplifier current·pull-up control circuit 34, a zero data detection circuit 35, and (3N) level setting circuits LS corresponding to (3N) data lines 13.

In addition, the data line driving circuit 30 may drive by time division the plurality of data lines 13 contained in each block (L is an integer of (3N/2) or less of two or more) by dividing (3N) data lines 13 to L blocks in order to read the gradation signal in (3N) pixel circuits 11 contained on one row line. Therefore, the data line driving circuit 30 may further include L demultiplexers DM(1) to DM(L).

Here, the number of data lines 13 which configure one block may be three. Hereinafter, as an example, a case is described in which 18 data lines 13 configure one block. For example, in a case where N=1944, 5832 data lines are divided into 324 blocks (L=324).

For example, a plurality of latch circuits 31 are configured by a plurality of D type flip flops and the like. As shown in FIG. 2, the plurality of latch circuits 31 may include a first group data latch circuit 311*a*, a first group determination flag latch circuit 311*b*, a second group data latch circuit 312*a*, and a second group determination flag latch circuit 312*b*.

The first group data latch circuit 311*a* is provided corresponding to the number of data lines (pixel number for one line), and the gradation data DATA used to drive the plurality of data lines is sequentially taken in in synchronization with the clock signal CLK in one horizontal synchronization period. For example, in a case where a bit number of each color of the gradation data DATA is K bits, the first group data latch circuit 311*a* is configured by (3N) K bit latch circuits.

The second group data latch circuit 312*a* is provided corresponding to the number of data lines (pixel number for one line), and the gradation data DATA output from the first group data latch circuit 311*a* is held in each one horizontal synchronization period. For example, in a case where a bit number of each color of the gradation data DATA is K bits, the second group data latch circuit 312*a* is configured by (3N) K bit latch circuits.

In this manner, while the pixel circuit 11 is driven for one line based on the gradation data DATA held in the second group data latch circuit 312*a* by providing two steps of latch circuits, the first group data latch circuit 311*a* is able to take in the gradation data DATA used to drive the subsequent pixel circuit 11 for one line.

The plurality of DAC 32 converts the gradation data DATA that is latched to the plurality of latch circuits 31 to a plurality of analog signals. The respective DAC 32 are provided with a plurality of gradation voltage generation circuits, and output the analog signals by selecting one from within the plurality of gradation voltages that are generated by the gradation voltage generation circuits. In a case where the plurality of data lines 13 are driven divided in L blocks, each of L DAC 32 sequentially converts the gradation data for one block that is output from the latch circuit of one block within the second group data latch circuit 312*a* to an analog signal for one block. Here, in gradation data for one block, gradation data of a data line of a predetermined number (18) included in one block is multiplexed by time division.

The plurality of amplifiers 33 respectively amplify the plurality of analog signals output from the plurality of DAC 32, and generates a plurality of gradation signals. For example, in a case where the plurality of data lines 13 are driven divided in L blocks, each of L amplifiers 33 amplifies the analog signal for one block sequentially output from the respective DAC 32 and generates the gradation signal Vd(k) for one block (k=1 to L). Here, in the gradation signal Vd(k), gradation data of a data line of a predetermined number (18) included in one block is multiplexed by time division. L amplifiers 33 respectively supply gradation signals Vd(1), Vd(2), . . . , Vd(L) to demultiplexers DM(1), DM(2), . . . , DM(L) that correspond to first, second, . . . , $L^{th}$ blocks.

Demultiplexers DM(1), DM(2), . . . , DM(L) respectively supply gradation signals Vd(1), Vd(2), . . . , Vd(L) for L blocks output from L amplifiers 33, and perform a switching operation such that the gradation signal Vd(k) for each block is supplied to a predetermined number (18) of data lines 13 by time division. Thereby, it is possible to reduce the number of DAC 32 and amplifiers 33 in comparison to a case where the DAC 32 and amplifiers 33 are provided on each data line 13.

For example, the gate line driving circuit 40 is configured by the logic circuit and the like which includes the combined circuit or the sequential circuit, and M scanning signals Gwr(1) to Gwr(M) for sequentially driving M scanning lines 12 are generated within one vertical synchronization period according to the control signal Ctr. Here, one vertical synchronization period is a period (one frame period) that is necessary for the display portion 10 to display one segment image. In addition, the gate line driving circuit 40 generates various control signals synchronized in the scanning signal in each row in another scanning signal, and the control signals are supplied to the display portion 10.

Amplifier Configuration Example

Figure 3:
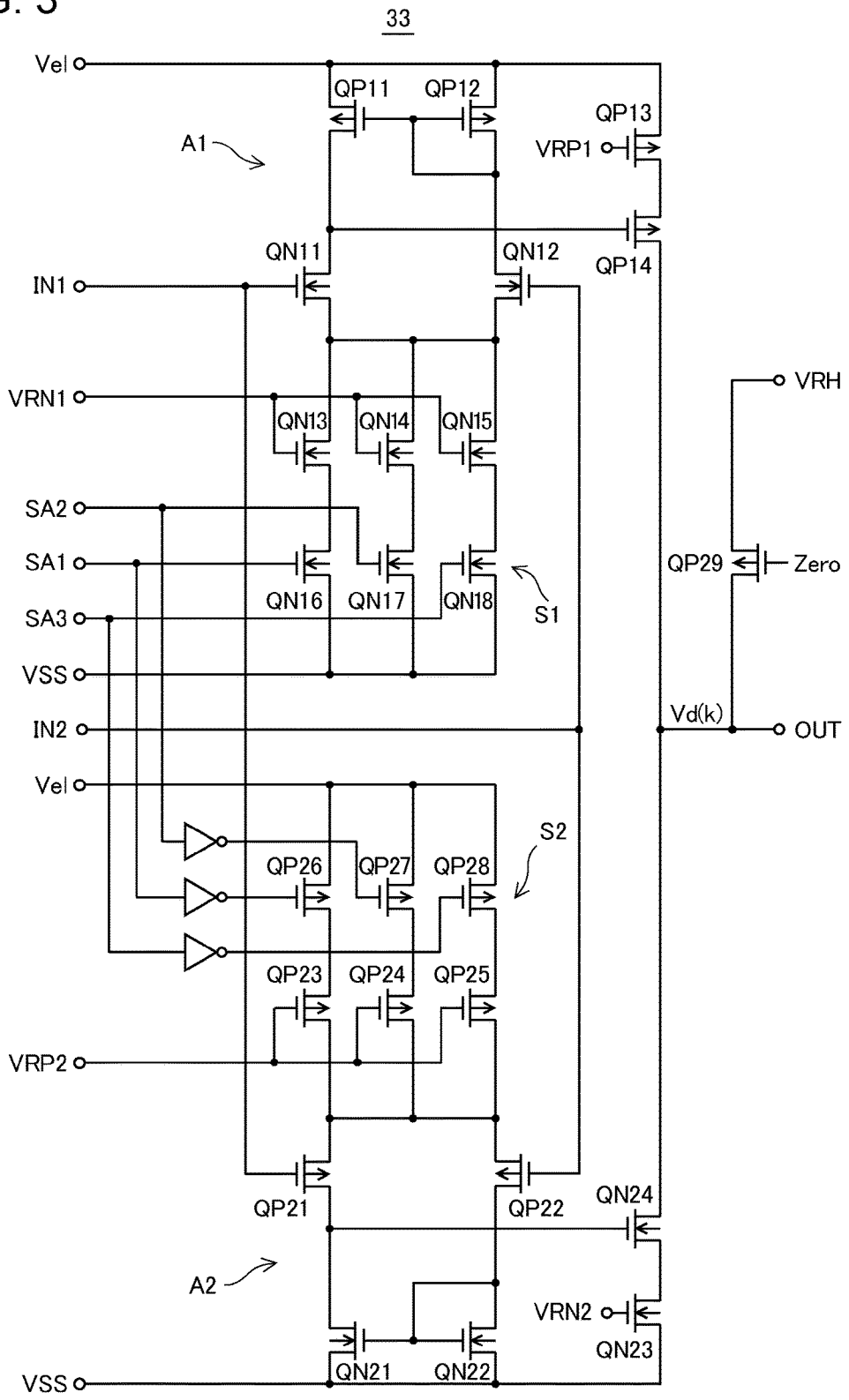
FIG. 3 is a circuit diagram illustrating a configuration example of an amplifier indicated in FIG. 2.

FIG. 3 is a circuit diagram illustrating a configuration example of the amplifier indicated in FIG. 2. As shown in FIG. 3, each amplifier 33 includes amplifier circuits A1 and A2 which perform the amplifier operation by supplying a power source potential Vel on a high potential side and a power source potential VSS on a low potential side and switch circuits S1 and S2 which, at respective speeds, switch a constant current (direct current) of the amplifier circuits A1 and A2.

The amplifier circuit A1 includes P channel MOS transistors QP11 to QP14 and N channel MOS transistors QN11 to QN15. A source of transistors QP11 and QP12 is connected to a wiring with the power source potential Vel, and the gate is connected to a drain of the transistor QP12.

The transistors QN11 and QN12 configure a differential pair. The drain of the transistor QN11 is connected to the drain of the transistor QP11, and a gate is connected to a first input terminal IN1. In addition, the drain of the transistor QN12 is connected to the drain of the transistor QP12, and a gate is connected to a second input terminal IN2.

The transistors QN13 to QN15 configure a constant current source. The drain of the transistors QN13 to QN15 is connected to a source of the transistors QN11 and QN12, and the reference potential VRN1 is applied to the gate. As the reference potential VRN1, a slightly higher potential than a threshold voltage of the transistors QN13 to QN15 are applied to the power source potential VSS. When the switch circuit S1 is on, the transistors QN13 to QN15 supply a constant current to the transistors QN11 and QN12. For example, the ratio of the constant current that flows in the transistors QN13, QN14, and QN15 is 1:4:5.

A source of the transistor QP13 is connected to a wiring of the power source potential Vel, and the reference potential VRP1 is applied to the gate. As the reference potential VRFP1, a slightly lower potential than a threshold voltage of the transistor QP13 is applied to the power source potential Vel. A source of the transistor QP14 is connected to a drain of the transistor QP13, the drain is connected to an output terminal OUT, and the gate is connected to the drain of the transistors QP11 and QN11.

The switch circuit S1 includes N channel MOS transistors QN16 to QN18. The transistors QN16 to QN18 respectively apply current control signals SA1 to SA3 to gates, and sets a constant current that flows to the constant current source transistors QN13 to QN15 to on or off.

The amplifier circuit A2 includes N channel MOS transistors QN21 to QN24 and P channel MOS transistors QP21 to QP25. A source of transistors QN21 and QN22 is connected to a wiring of the power source potential VSS, and the gate is connected to a drain of the transistor QN22.

The transistors QP21 and QP22 configure a differential pair. The drain of the transistor QP21 is connected to the drain of the transistor QN21, and a gate is connected to a first input terminal IN1. In addition, the drain of the transistor QP22 is connected to the drain of the transistor QN22, and a gate is connected to a second input terminal IN2.

The transistors QP23 to QP25 configure a constant current source. The drain of the transistors QP23 to QP25 is connected to a source of the transistors QP21 and QP22, and the reference potential VRP2 is applied to the gate. As the reference potential VRP2, a slightly lower potential than a threshold voltage of the transistors QP23 to QP25 is applied to the power source potential Vel. When the switch circuit S2 is on, the transistors QP23 to QP25 supply a constant current to the transistors QP21 and QP22. For example, the ratio of the constant current that flows to the transistors QP23, QP24, and QP25 is 1:4:5.

A source of the transistor QN23 is connected to a wiring of the power source potential VSS, and the reference potential VRN2 is applied to the gate. As the reference potential VRN2, a slightly higher potential than a threshold voltage of the transistor QN23 is applied to the power source potential VSS. A source of the transistor QN24 is connected to a drain of the transistor QN23, the drain is connected to an output terminal OUT, and the gate is connected to the drain of the transistors QN21 and QP21.

The switch circuit S2 includes P channel MOS transistors QP26 to QP28. The transistors QP26 to QP28 respectively apply current control signals SA1 to SA3 to gates via three inverters, and sets a constant current that flows in the constant current source transistors QP23 to QP25 to on or off.

The amplifier 33 configured in this manner is used as a voltage follower type amplifier by connecting the input terminal IN2 and the output terminal OUT, and substantially the same voltage as the voltage of the analog signal that is applied to the input terminal IN1 is output from the output terminal OUT as the gradation signal Vd(k).

Configuration Example of Demultiplexer and Level Setting Circuit

Figure 4:
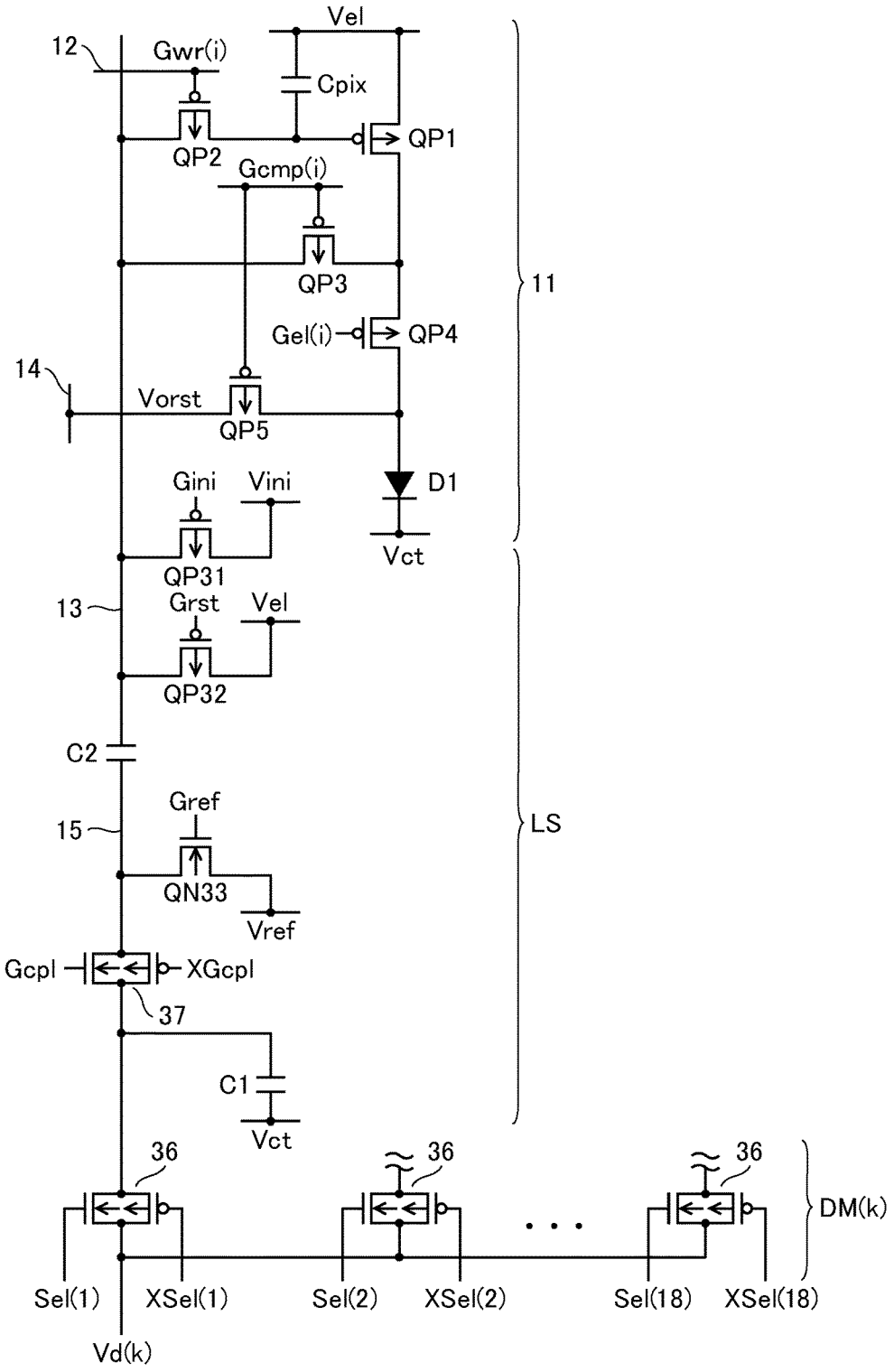
FIG. 4 is a circuit diagram illustrating a configuration example of a level setting circuit and the like indicated in FIG. 2.

FIG. 4 is a circuit diagram illustrating a configuration example of a demultiplexer, a level setting circuit, and a pixel circuit indicated in FIG. 2. One demultiplexer DM(k)

within the demultiplexers DM(1) to DM(L), one level setting circuit LS, and one pixel circuit 11 indicated in FIG. 2 are indicated in FIG. 4.

The demultiplexer DM(k) includes a plurality of transmission gates 36 that are provided in each column of the pixel circuit 11, and the gradation signal Vd(k) is supplied by time division to 18 level setting circuits LS that are respectively connected to 18 data lines 13 which are included in a $k^{th}$ block. The input terminal of the plurality of transmission gates 36 are connected commonly with each other, and the gradation signal Vd(k) is supplied to the input terminals.

In the demultiplexer DM(k), the transmission gate 36 that is provided in the first column is in a conductive state (on state) when a control signal Sel(1) which is supplied from the display control circuit 20 indicated in FIG. 2 is a high level (control signal XSel(1) is a low level), and is in a non-conductive state (off state) when the control signal Sel(1) is a low level (control signal XSel(1) is a high level).

In addition, in the demultiplexer DM(k), the transmission gate 36 that is provided in the second column is in an on state when a control signal Sel(2) is a high level. In the same manner below, in the demultiplexer DM(k), the transmission gate 36 that is provided in the eighteenth column is in an on state when a control signal Sel(18) is a high level.

The plurality of level setting circuits LS are also provided in each column of pixels corresponding to the plurality of transmission gates 36. Each level setting circuit LS includes capacitors C1 and C2, a transmission gate 37, P channel MOS transistors QP31 and QP32, and an N channel MOS transistor QN33, and sets the potential of the data line 13.

One electrode of the capacitor C1 is connected to the output terminal of the transmission gate 36, and another electrode of the capacitor C1 is connected to a supply line of the power source potential Vct on the low potential side on the display portion 10. When the transmission gate 36 is in the on state, the gradation signal Vd(k) is supplied to the one electrode of the capacitor C1. The transmission gate 37 is connected between the one electrode of the capacitor C1 and a relay wiring 15.

The transistor QP31 is connected between the data line 13 and the supply line of the initialization potential Vini. The transistor QP32 is connected between the data line 13 and the supply line of the power source potential Vel on the high potential side on the display portion 10. The capacitor C2 is connected between the data line 13 and the relay wiring 15. The transistor QN33 is connected between the relay wiring 15 and the supply line of the reference potential Vref.

The display control circuit 20 indicated in FIG. 2 commonly applies a control signal Gini to the gate of the transistor QP31 of a plurality of columns. When the transistor QP31 of a plurality of columns has the control signal Gini of a low level, the supply line of the initialization potential Vini is electrically connected to the data line 13 in an altogether on state, and when the control signal Gini is a high level, both are not electrically connected.

In addition, the display control circuit 20 is commonly supplied to the control signals Gcpl and XGcpl in the transmission gate 37 of a plurality of columns. When the transmission gate 37 of a plurality of columns has the control signal Gcpl of a high level, one electrode of the capacitor C1 is electrically connected to the relay wiring 15 in an altogether on state, and when the control signal Gcpl is a low level, both are not electrically connected.

The analysis circuit 23 indicated in FIG. 2 commonly applies a control signal Grst to the transistor QP32 of a plurality of columns. When the transistor QP32 of a plurality of columns has the control signal Grst of a low level, the supply line of the power source potential Vel is electrically connected to the data line 13 in an altogether on state, and when the control signal Grst is a high level, both are not electrically connected.

In addition, the analysis circuit 23 commonly applies a control signal Gref to the transistor QN33 of a plurality of columns. When the transistor QN33 of a plurality of columns has the control signal Gref of a high level, the supply line of the reference potential Vref is electrically connected to the relay wiring 15 in an altogether on state, and when the control signal Gref is a low level, both are not electrically connected.

Pixel Circuit Configuration Example

The pixel circuit 11 includes a light-emitting element D1, P channel MOS transistors QP1 to QP5, and a holding capacitor Cpix. For example, the light-emitting element D1 is an OLED that interposes a white organic EL layer using an anode formed on a silicon substrate and a cathode having light permeability. The anode of the light-emitting element D1 is a pixel electrode individually provided in each pixel circuit. In contrast to this, the cathode of the light-emitting element D1 is a common electrode that is commonly provided in all pixel circuits, and is held in the power source potential Vct on the low potential side in the display portion 10.

A color filter that corresponds to any of RGB is provided on an emission side (cathode side) of the light-emitting element D1. Note that, a cavity structure may be formed to adjust an optical distance between two reflective layers that are disposed to interpose the white organic EL layer, and a wavelength of light that is emitted from the light-emitting element D1 may be set. In this case, the color filter may be provided or may not be provided.

In such a light-emitting element D1, when current flows from the anode to the cathode, an exciton is generated by recombining a positive hole that is injected from the anode and an electron that is injected from the cathode using the organic EL layer, and white light is emitted. White light generated at this time passes through the cathode on the opposite side from the silicon substrate (anode), and is emitted from the display portion 10 through coloring using the color filter.

The gate line driving circuit 40 indicated in FIG. 2 supplies a scanning signal Gwr(i) to a scanning line 12 of an $i^{th}$ row. In addition, the gate line driving circuit 40 supplies the control signals Gcmp(i) and Gel(i) to a plurality of control lines of the $i^{th}$ row.

One out of the source and the drain of the transistor QP2 is electrically connected to the data line 13, and the other out of the source and the drain is electrically connected to one electrode of the holding capacitor Cpix and a gate of the driving transistor QP1. The gate of the transistor QP2 is electrically connected to the scanning line 12, and the scanning signal Gwr(i) is supplied. The transistor QP2 functions as a switching transistor that controls the electrical connection between the data line 13 and the gate of the driving transistor QP1.

The other electrode of the holding capacitor Cpix is electrically connected to the supply line of the power source potential Vel on the high potential side on the display portion 10. Thereby, the holding capacitor Cpix functions as a capacitor that holds a voltage between the gate and source of the driving transistor QP1.

A source of the driving transistor QP1 is electrically connected to a supply line of the power source potential Vel, and the drain is electrically connected to the source of the transistor QP4. The driving transistor QP1 drives the light-emitting element D1 such that a drain current flows according to the voltage between the source and gate.

The source and the drain of the transistor QP3 is electrically connected be] the data line 13 and the drain of the driving transistor QP1. Note that, the transistor QP3 may be connected between the gate and the drain of the driving transistor QP1. The control signal Gcmp(i) is supplied to the gate of the transistor QP3. The transistor QP3 functions as a switching transistor that controls the electrical connection between the gate and the drain of the driving transistor QP1.

The drain of the transistor QP4 is electrically connected to the anode of the light-emitting element D1 and the source of the transistor QP5. The control signal Gel(i) is supplied to the gate of the transistor QP4. The transistor QP4 functions as a switching transistor that controls the electrical connection between the drain of the driving transistor QP1 and the anode of the light-emitting element D1.

The drain of the transistor QP5 is electrically connected to the reset line 14, and is held at the reset potential Vorst. The control signal Gcmp(i) is supplied to the gate of the transistor QP5. The transistor QP5 functions as a switching transistor that controls the electrical connection between the reset line 14 and an anode of the light-emitting element D1.

In FIG. 4, the P channel MOS transistor is used in the pixel circuit 11, but an N channel layer MOS transistor may be used in place of the P channel MOS transistor. In a case where the N channel layer MOS transistor is used in the pixel circuit 11, the connection relationship between the source and drain of the transistor are reverse to above, and polarity of the scanning signal, the control signal, and the gradation signal are also reverse. Alternatively, the P channel MOS transistor and the N channel MOS transistor may be used appropriately combined. In addition, the transistor of the pixel circuit 11 may be a thin film transistor.

As the holding capacitor Cpix, a parasitic capacitance may be used associated to a gate of the driving transistor QP1. Alternatively, as the holding capacitor Cpix, a capacitor may be used that is formed by interposing an inter-layer dielectric film using a wiring in a plurality of different wiring layers provided on the silicon substrate.

Display Device Operation Example

Next, an operation example of the display device indicated in FIGS. 2 to 4 will be described. The display control circuit 20 inputs image data and a synchronization signal (vertical synchronization signal VSYNC, horizontal synchronization signal HSYNC, data enabling signal DE, and data clock signal DCLK) from the external apparatus 6, and transmits the gradation data DATA and the clock signal CLK for internalization to the data line driving circuit 30.

In the first embodiment, the analysis circuit 23 determines whether or not the gradation level is the predetermined level or less of the gradation data for one line latched to the plurality of latch circuits 31. For example, when the first group data latch circuit 311*a* sequentially takes in the gradation data DATA in synchronization with the clock signal CLK, the analysis circuit 23 determines whether or not the gradation level represented by the gradation data taken in to the first group data latch circuit 311*a* is the predetermined level or less concerning the gradation data for one line.

For example, three color components of RGB are individually provided with a first threshold, a second threshold, and a third threshold. In a case where the level of an R component of the gradation data is the first threshold or less, the level of a G component of the gradation data is the second threshold or less, and the level of a B component of the gradation data is the third threshold or less, the analysis circuit 23 determines whether or not the gradation level represented by the gradation data is a predetermined level or less.

Here, the first threshold to the third threshold may be equal. Alternatively, the first threshold to the third threshold may be zero. In a case where the first threshold to the third threshold is zero, the analysis circuit 23 determines whether or not the gradation level represented by the gradation data is the black level. In particular, in a case of a head mounted display, an image being displayed on a black background is considered to be predominant. The reason being, if the background is black, it is not possible to see a screen boundary on which the other side of the display is clearly visible, but when the background is gray, since the screen boundary is noticeable due to floating of the background, the other side of the display is difficult to recognize.

In a case where the gradation level of all pixels on one line is a predetermined level or less, the analysis circuit 23 activates a control signal SAMP in a period (for example, one horizontal synchronization period) in which the pixel circuit 11 of one line is driven based on the gradation data for one line. For example, the amplifier current·pull-up control circuit 34 is configured by a gate circuit, and controls direct current and a pull-up state in the plurality of amplifiers 33 according to the control signal SAMP. Thereby, in a case where the gradation level of all pixels on one line is a predetermined level or less, the analysis circuit 23 reduces direct current that flows in the plurality (L) of amplifiers 33 in a period in which the pixel circuit 11 of one line is driven based on the gradation data for one line.

In a case where the gradation level of all pixels in one line is a predetermined level or less, since the gradation level of the pixels is a black level or a low brightness level close to the black level, display unevenness and the like is difficult to visually recognize. Accordingly, it is possible to reduce the current consumption of the plurality of amplifiers 33 imparting almost no influence on image quality.

The amplifier current·pull-up control circuit 34 controls direct current that flows in the plurality of amplifiers 33 by generating the current control signals SA1 to SA3 to supply to the plurality of amplifiers 33. For example, in the amplifier 33 indicated in FIG. 3, if the current control signals SA1 to SA3 are not activated at a low level, it is possible to stop direct current by setting the transistors QN16 to QN18 and QP26 to QP28 that configure the switch circuits S1 and S2 to the off state.

A general operation of the display device will be described with reference to FIG. 4. As an initial state, the control signals Gini and Grst are not activated at a high level, and the control signals Gref and Gcpl are not activated at a low level. Accordingly, in the level setting circuit LS, the transistors QP31, QP32, and QN33 and the transmission gate 37 are in an off state.

In addition, as the initial state, the control signal Gwr(i) and the control signal Gcmp(i) are not activated at a high level, and the control signal Gel(i) is activated at a low level. Accordingly, in the pixel circuit 11, the transistors QP2, QP3, and QP5 are in the off state, and the transistor QP4 is in the on state.

When the $i^{th}$ horizontal synchronization period within one vertical synchronization period, the display control circuit 20 sequentially activates the control signals Sel(1) to Sel(18) at a high level in a predetermined period within one horizontal synchronization period. Thereby, in the demultiplexer DM(k), the transmission gate 36 to which the control signals Sel(1) to Sel(18) are applied are sequentially set to the on state.

In addition, in the predetermined period above, a $k^{th}$ block amplifier 33 switches a voltage of the gradation signal Vd(k) in order of gradation voltage corresponding to the gradation level of pixels of the first column, the second column, . . . , and the eighteenth column in the $k^{th}$ block. Thereby, in the $k^{th}$ block, the respective gradation voltages are charged in the capacitor C1 corresponding to the pixel of the first column, the second column, . . . , and the eighteenth column.

Meanwhile, the display control circuit 20 activates the control signal Gini to a low level in the predetermined period above. Thereby, in the level setting circuit LS, the transistor QP31 is in the on state and the initialization potential Vini is supplied to the data line 13 (initialization period). In addition, the gate line driving circuit 40 does not activate the control signal Gel(i) which is supplied to the $i^{th}$ row pixel circuit 11 at a high level. Thereby, in the pixel circuit 11, the transistor QP4 is in the off state and the light-emitting element D1 of the $i^{th}$ row pixel circuit 11 is in the reset state.

Next, the gate line driving circuit 40 activates the scanning signal Gwr(i) which is supplied to the $i^{th}$ row scanning line 12 at a low level and activates the control signal Gcmp(i) which is supplied to the $i^{th}$ row pixel circuit 11 at a low level. Thereby, the transistors QP2, QP3, and QP5 are in an on state and the gate potential of the driving transistor QP1 is set to a constant value (compensation period). After that, the control signal Gcmp(i) is not activated at the high level again and the transistors QP3 and QP5 are set to the off state.

Furthermore, the display control circuit 20 does not activate the control signal Gini at a high level and activates the control signal Gcpl to a high level. Thereby, the transistor QP31 is set in the off state and the transmission gate 37 is set in the on state. Accordingly, the gradation signal is applied to the gate of the driving transistor QP1, and the gradation voltage is charged to the holding capacitor Cpix (writing period). When writing of the gradation signal with respect to the $i^{th}$ row pixel circuit 11 ends, the gate line driving circuit 40 does not activate the scanning signal Gwr(i) which is supplied to the $i^{th}$ row scanning line 12 at a high level and the display control circuit 20 does not activate the control signal Gcpl at a low level.

After an $(i+1)^{th}$ horizontal synchronization period within one vertical synchronization period ends, the gate line driving circuit 40 activates the control signal Gel(i) which is supplied to the $i^{th}$ row pixel circuit 11 at a low level. Thereby, in an $(i+2)^{th}$ horizontal synchronization period and thereafter, since the transistor QP4 is in the on state and the driving transistor QP1 supplies current to the light-emitting element D1 according to the gradation signal, the light-emitting element D1 of the pixel circuit 11 of an $i^{th}$ row is emitted (light emission period).

By doing this, in the $i^{th}$ horizontal synchronization period, the driving period (initialization period, compensation period, and writing period) of the $i^{th}$ row pixel circuit 11 is provided, and in the $(i+2)^{th}$ horizontal synchronization period and thereafter, the light emission period of the $i^{th}$ row pixel circuit 11 is provided. Then, in one line, after one vertical synchronization period has elapsed from the start of the driving period, the driving period is provided again.

Alternatively, the gradation signal may be supplied altogether to all data lines 13 that do not use the demultiplexers DM(1) to DM(L) without blocking the data lines 13. In this case, the plurality of amplifiers 33 directly drive the plurality of level setting circuit LS without going through the demultiplexer DM.

Above, in a case where the gradation level of all pixels of an $i^{th}$ line is a predetermined level or less, the analysis circuit 23 reduces direct current that flows in the plurality of amplifiers 33 in a period in which the pixel circuit 11 of the $i^{th}$ line is driven based on the gradation data for the $i^{th}$ line. At that time, the analysis circuit 23 may control potential of the plurality of data lines 13 such that the driving transistor QP1 of the pixel circuit 11 of the $i^{th}$ line that is driven based on the gradation data for the $i^{th}$ line is in an off state. Thereby, even if the direct current which flows in the plurality of amplifiers 33 is reduced, it is possible to stop light emission by the light-emitting element D1 of the pixel circuit 11 of the $i^{th}$ line.

For example, the analysis circuit 23 activates the control signal Grst at a low level, and activates the control signal Gref at a high level. Thereby, in the level setting circuit LS, the transistors QP32 and QN33 are in the on state. Accordingly, the power source potential Vel is supplied to the data line 13 and the driving transistor QP1 is in the off state. In addition, the reference potential Vref is supplied to the relay wiring 15.

Second Embodiment

Next, a second embodiment of the invention will be described. In the second embodiment, the analysis circuit 23 indicated in FIG. 2 determines whether or not the gradation level is the predetermined level or less of the gradation data for one block latched to the plurality of latch circuits 31.

For example, when the first group data latch circuit 311*a* sequentially takes in the gradation data DATA in synchronization with the clock signal CLK, the analysis circuit 23 determines whether or not the gradation level represented by the gradation data taken in to the first group data latch circuit 311*a* is the predetermined level or less concerning the gradation data for one block (for 18 pixels). Thereby, the analysis circuit 23 generates a determination flag FZ that represents whether or not the gradation level of all pixels of one block is the predetermined level or less and outputs to the first group determination flag latch circuit 311*b*.

The first group determination flag latch circuit 311*b* includes L latch circuits that latch the determination flag FZ corresponding to L DAC 32 or L amplifiers 33. The second group determination flag latch circuit 312*b* includes L latch circuits that latch the determination flag FZ corresponding to L DAC 32 or L amplifiers 33.

The first group data latch circuit 311*a* sequentially takes in the gradation data DATA, and the first group determination flag latch circuit 311*b* sequentially takes in the determination flag FZ that is output from the analysis circuit 23 to each block. In one horizontal synchronization period, the determination flag FZ in gradation data for L blocks is taken in to the first group determination flag latch circuit 311*b*. When the subsequent horizontal synchronization period starts, the second group data latch circuit 312*a* takes in the gradation data DATA for L blocks that are output from the first group data latch circuit 311*a*, and the second group determination flag latch circuit 312*b* holds the determination flag FZ for L blocks that are output from the first group determination flag latch circuit 311*b*.

In a case where the gradation level of all pixels of one block is the predetermined level or less according to the determination flag FZ that is held in the second group determination flag latch circuit 312*b*, the amplifier current·pull-up control circuit 34 reduces the direct current that flows in the amplifiers 33 that are connected to the DAC 32 to which the gradation data for one block is supplied in a period (for example, one horizontal synchronization period) in which the pixel circuit 11 of the one block is driven based on the gradation data for one block.

In a case where the gradation level of all pixels in one block is a predetermined level or less, since the gradation level of the pixels is a black level or a low brightness level close to the black level, display unevenness and the like is difficult to visually recognize. Accordingly, it is possible to reduce the current consumption of the amplifiers 33 that are connected to the DAC 32 to which gradation data for one block is supplied imparting almost no influence on image quality.

It is possible to control direct current that flows in the plurality of amplifiers 33 by generating the current control signals SA1 to SA3 in each of the plurality of amplifiers 33 to supply to the plurality of amplifiers 33. For example, in the amplifier 33 indicated in FIG. 3, if the current control signals SA2 and SA3 are not activated at a low level while maintaining the current control signal SA1 at a high level, it is possible to maintain the transistors QN16 and QP26 in the on state, set the transistors QN17, QN18, QP27, and QP28 to the off state, and for example, set direct current to 1/10.

As shown in FIG. 3, the P channel MOS transistor QP29 that pulls up the output terminal OUT to a maximum potential VRH of the gradation signal is provided in the amplifier 33. The source of the transistor QP29 is connected to a wiring of the maximum potential VRH of the gradation signal, and the drain is connected to the output terminal OUT. The amplifier current·pull-up control circuit 34 applies a control signal Zero to the gate of the transistor QP29 by generating the control signal Zero in each of a plurality of amplifier 33 to supply to the plurality of amplifiers 33.

When direct current that flows to the amplifier 33 is reduced, the control signal Zero may activate at a low level. As a result, since the transistor QP29 is in the on state and the output terminal OUT of the amplifier 33 is pulled up to the maximum potential VRH of the gradation signal, the driving transistor QP1 of the pixel circuit 11 indicated in FIG. 4 is set to the off state. Thereby, even if the direct current which flows in the amplifier 33 is reduced, it is possible to stop light emission by the light-emitting element D1 of the pixel circuit 11 corresponding to the amplifier 33.

In the second embodiment, the transistor QP32, the transistor QN33, and the capacitor C2 of the level setting circuit LS indicated in FIG. 4 may be omitted, and the data line 13 may be directly connected to the relay wiring 15. With regard to other points, the second embodiment may be the same as the first embodiment.

Third Embodiment

Next, a third embodiment of the invention will be described. In the third embodiment, the zero data detection circuit 35 indicated in FIG. 2 functions as the analysis circuit which analyzes the gradation data that is latched to the plurality of latch circuits 31. The zero data detection circuit 35 determines whether or not the value of the gradation data for one pixel that is supplied to each of a plurality of DAC 32 is zero. For example, the zero data detection circuit 35 determines whether or not the value of the gradation data for one pixel that is supplied to each of a plurality of DAC 32 from the second group data latch circuit 312*a* is zero, and the determination result is output to the amplifier current·pull-up control circuit 34.

The amplifier current·pull-up control circuit 34 controls direct current in respective amplifiers 33 according to the determination result of the zero data detection circuit 35. Thereby, in a case where the zero data detection circuit 35 sets the value of the gradation data for one pixel to zero, direct current that flows in the amplifiers 33 that are connected to the DAC 32 to which the gradation data for one pixel is supplied is reduced in a period in which one pixel circuit 11 is driven based on the gradation data for one pixel. With regard to other points, the third embodiment may be the same as the second embodiment.

In a case where the value of gradation data for one pixel is zero, it is not necessary for the light-emitting element D1 of the pixel circuit 11 of the pixel to emit light. Accordingly, it is possible to reduce the current consumption of the amplifiers 33 that are connected to the DAC 32 to which gradation data for one block is supplied imparting almost no influence on image quality.

Fourth Embodiment

Next, a fourth embodiment of the invention will be described. In the fourth embodiment, the analysis circuit 23 indicated in FIG. 2 determines whether or not the gradation level is the predetermined level or more of the gradation data for one line latched to the plurality of latch circuits 31. For example, when the first group data latch circuit 311*a* sequentially takes in the gradation data DATA in synchronization with the clock signal CLK, the analysis circuit 23 determines whether or not the gradation level represented by the gradation data taken in to the first group data latch circuit 311*a* is the predetermined level or more concerning the gradation data for one line.

For example, three color components of RGB are individually provided with a fourth threshold, a fifth threshold, and a sixth threshold. In a case where the level of an R component of the gradation data is the fourth threshold or more, the level of a G component of the gradation data is the fifth threshold or more, and the level of a B component of the gradation data is the sixth threshold or more, the analysis circuit 23 determines whether or not the gradation level represented by the gradation data is a predetermined level or more.

Here, the fourth threshold to the sixth threshold may be equal. Alternatively, the fourth threshold to the sixth threshold may be a maximum gradation level. In a case where the fourth threshold to the sixth threshold is the maximum gradation level, the analysis circuit 23 determines whether or not the gradation level represented by the gradation data is the white level.

In a case where the gradation level of all pixels on one line is a predetermined level or more, the analysis circuit 23 activates a control signal SAMP in a period (for example, one horizontal synchronization period) in which the pixel circuit 11 of one line is driven based on the gradation data for one line. For example, the amplifier current·pull-up control circuit 34 controls direct current in the plurality of amplifiers 33 according to the control signal SAMP. Thereby, in a case where the gradation level of all pixels on one line is a predetermined level or more, the analysis circuit 23 reduces direct current that flows in the plurality (L) of amplifiers 33 in a period in which the pixel circuit 11 of one line is driven based on the gradation data for one line. With regard to other points, the fourth embodiment may be the same as any one of the first to third embodiments.

In a case where the gradation level of all pixels in one line is a predetermined level or more, since the gradation level of the pixels is a white level or a high brightness level close to the white level, display unevenness and the like is difficult to visually recognize. Accordingly, it is possible to reduce the current consumption of the plurality of amplifiers 33 imparting almost no influence on image quality.

Fifth Embodiment

Next, a fifth embodiment of the invention will be described. In the fifth embodiment, the DAC 32 indicated in FIG. 2 is configured to be able to vary direct current. The analysis circuit 23 controls direct current of the DAC 32 in place of or in addition to controlling direct current of the amplifier 33 in the first to fourth embodiments. Therefore, the analysis circuit 23 generates a control signal SDAC which controls direct current in the DAC 32. With regard to other points, the fifth embodiment may be the same as any one of the first to fourth embodiments.

Figure 5:
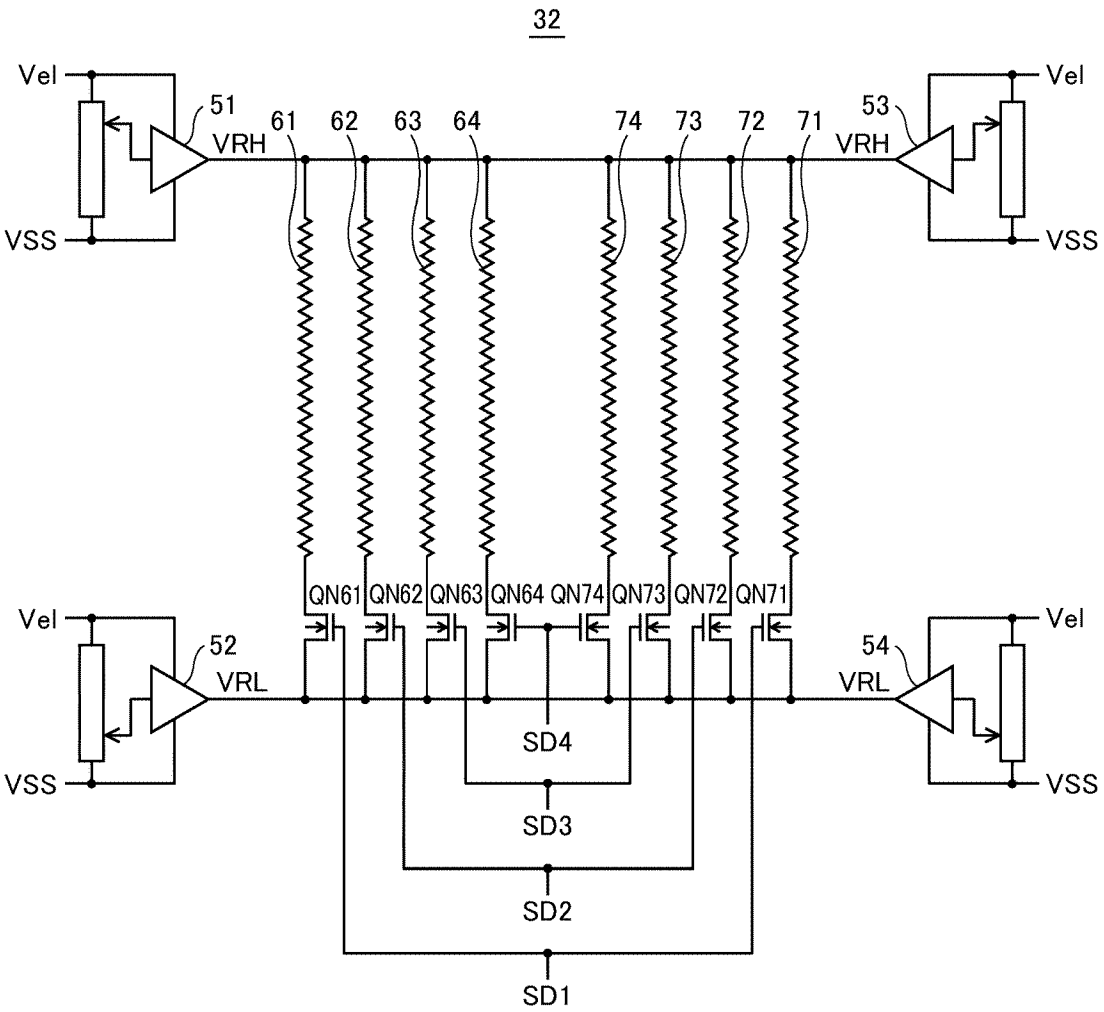
FIG. 5 is a diagram illustrating a configuration example of a part of a DAC indicated in FIG. 2.

FIG. 5 is a diagram illustrating a configuration example of a part of the DAC indicated in FIG. 2. As shown in FIG. 5, the DAC 32 includes regulators (fixed voltage circuit) 51 to 54, gradation voltage generation circuits 61 to 64 and 71 to 74, and N channel MOS transistors QN61 to QN64 and QN71 to QN74.

The regulators 51 and 53 generate a first stabilization potential VRH that is a maximum potential of the gradation signal. The first stabilization potential VRH is supplied to the first terminal of the gradation voltage generation circuits 61 to 64 and 71 to 74. In addition, the regulators 52 and 54 generate a second stabilization potential VRL that is a minimum potential of the gradation signal.

For example, the respective gradation voltage generation circuits 61 to 64 and 71 to 74 are configured by a ladder resistor or a combination of the ladder resistor and the plurality of buffer amplifiers. For example, the resistance value of the ladder resistor is approximately 4 kΩ, and when all of the gradation voltage generation circuits 61 to 64 and 71 to 74 are connected between the wiring of the first stabilization potential VRH and the wiring of the second stabilization potential VRL. The resistance value therebetween is approximately 500Ω.

The drain of the transistors QN61 to QN64 and QN71 to QN74 is respectively connected to a second terminal of the gradation voltage generation circuits 61 to 64 and 71 to 74, and the source is connected to the wiring of the second stabilization potential VRL. A current control signal SD1 is applied to the gate of the transistors QN61 and QN71, and a current control signal SD2 is applied to the gate of the transistors QN62 and QN72. In addition, a current control signal SD3 is applied to the gate of the transistors QN63 and QN73, and a current control signal SD4 is applied to the gate of the transistors QN64 and QN74.

For example, in a full operation mode, the current control signals SD1 to SD4 are activated at a high level. Thereby, the transistors QN61 to QN64 and QN71 to QN74 is set in the on state. As a result, the second terminal of the gradation voltage generation circuits 61 to 64 and 71 to 74 are electrically connected to the wiring of the second stabilization potential VRL, and current flows in the gradation voltage generation circuits 61 to 64 and 71 to 74.

Meanwhile, in the full operation mode, upon the current control signals SD1 and SD2 being activated at a high level, the current control signals SD3 and SD4 are not activated at a low level. Thereby, the transistors QN61, QN62, QN71, and QN72 are set to the on state, and the transistors QN63, QN64, QN73, and QN74 are set to the off state. As a result, since current flows in the gradation voltage generation circuits 61, 62, 71, and 72 and current does not flow in the gradation voltage generation circuits 63, 64, 73, and 74, it is possible to set direct current to approximately half of direct current in the full operation mode.

Figure 6A:
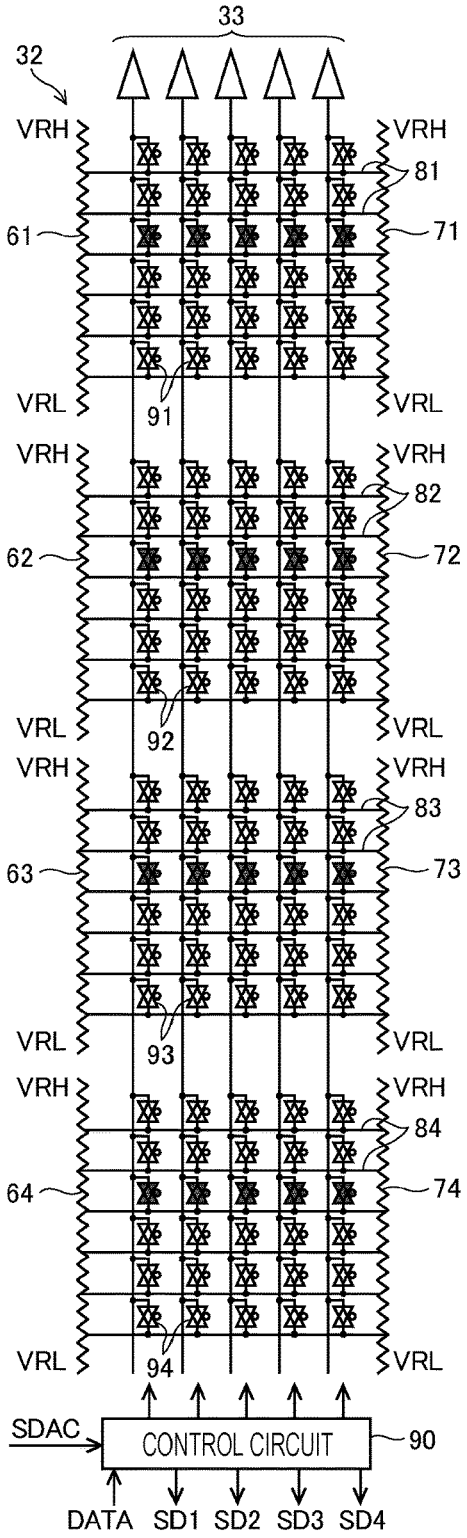
FIGS. 6A and 6B are diagrams for describing a connection state of a gradation voltage generation circuit indicated in FIG. 5.
Figure 6B:
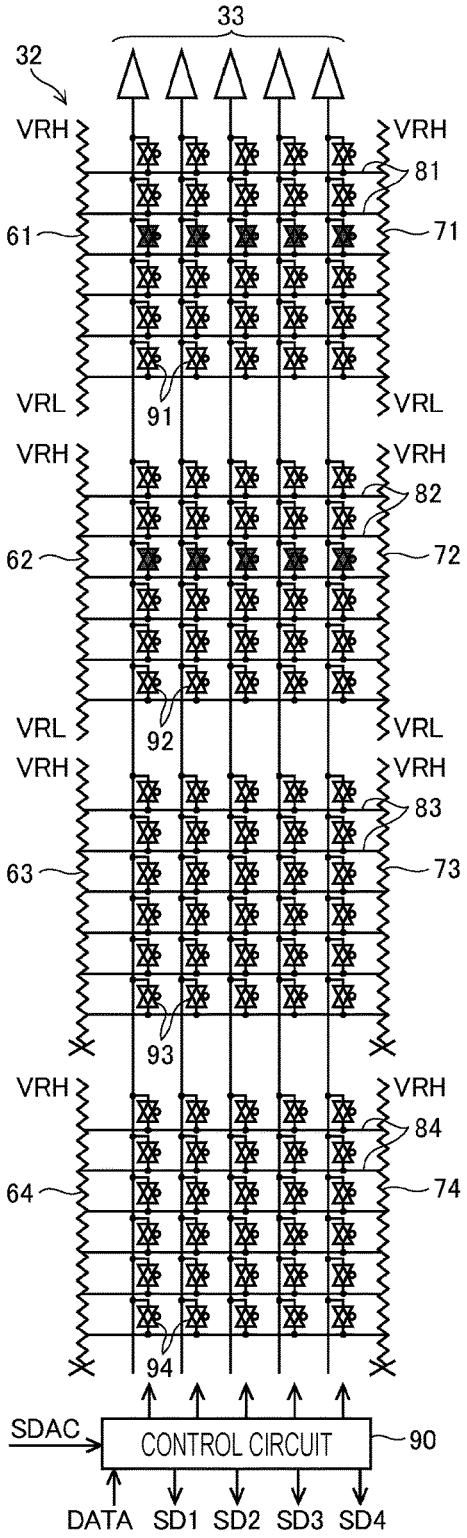

FIGS. 6A and 6B are diagrams for describing a connection state of gradation voltage generation circuit indicated in FIG. 5. FIG. 6A indicates a connection state of the gradation voltage generation circuit in the full operation mode, and FIG. 6B indicates a connection state of gradation voltage generation circuit in the full operation mode. In the full operation mode, the second terminal of the gradation voltage generation circuits 63, 64, 73, and 74 is in an open state (x arrow).

As shown in FIGS. 6A and 6B, a first group gradation line 81 is connected to the gradation voltage generation circuits 61 and 71, and a second group gradation line 82 is connected to the gradation voltage generation circuits 62 and 72. In addition, a third group gradation line 83 is connected to the gradation voltage generation circuits 63 and 73, and a fourth group gradation line 84 is connected to the gradation voltage generation circuits 64 and 74.

The gradation voltage generation circuits 61 and 71 supply the first stabilization potential VRH and the second stabilization potential VRL from the regulators 51 to 54 indicated in FIG. 5, and generate a plurality of gradation voltages and supplies to the first group gradation line 81. In addition, the gradation voltage generation circuits 62 and 72 supply the first stabilization potential VRH and the second stabilization potential VRL, and generate a plurality of gradation voltages and supplies to the second group gradation line 82.

The gradation voltage generation circuits 63 and 73 supply the first stabilization potential VRH and the second stabilization potential VRL, and generate a plurality of gradation voltages and supplies to the third group gradation line 83. In addition, the gradation voltage generation circuits 64 and 74 supply the first stabilization potential VRH and the second stabilization potential VRL, and generate a plurality of gradation voltages and supplies to the fourth group gradation line 84.

Furthermore, the DAC 32 includes a control circuit 90, and a first group switch circuit 91 to a fourth group switch circuit 94. For example, the first group switch circuit 91 to the fourth group switch circuit 94 is configured by a plurality of transmission gates that are connected between an input terminal of the plurality of amplifiers 33 and the first group gradation line 81 to the fourth group gradation line 84.

The first group switch circuit 91 electrically connects the gradation lines that are respectively selected from within the first group gradation line 81 in each of the input terminals of the plurality of amplifiers 33, and the second group switch circuit 92 electrically connects the gradation lines that are respectively selected from within the second group gradation line 82 in each of the input terminals of the plurality of amplifiers 33.

In addition, the third group switch circuit 93 electrically connects the gradation lines that are respectively selected from within the third group gradation line 83 in each of the input terminals of the plurality of amplifiers 33, and the fourth group switch circuit 94 electrically connects the gradation lines that are respectively selected from within the fourth group gradation line 84 in each of the input terminals of the plurality of amplifiers 33.

For example, the control circuit 90 is configured by a logic circuit including a combined circuit or a sequential circuit. The control circuit 90 decodes gradation data that is supplied from the second group data latch circuit 312*a* indicated in FIG. 2, generates a switch circuit signal for controlling the first group switch circuit 91 to the fourth group switch circuit 94, and supplies to the first group switch circuit 91 to the fourth group switch circuit 94.

In addition, the control circuit 90 generates the current control signals SD1 to SD4 which control current that flows in the gradation voltage generation circuits 61 to 64 and 71 to 74 based on the control signal SDAC that is output from the analysis circuit 23. The control circuit 90 controls a switch circuit that connects to the gradation voltage generation circuit through which current flows according to the current control signals SD1 to SD4 to on or off according to the gradation data, and the switch circuit which connects to the gradation voltage generation circuit through which current does not flow is forcibly set to off.

In the full operation mode indicated in FIG. 6A, the current control signals SD1 to SD4 are activated at a high level and current flows in the gradation voltage generation circuits 61 to 64 and 71 to 74. The control circuit 90 commonly controls the first group switch circuit 91 to the fourth group switch circuit 94 such that the gradation line corresponding to the gradation level that is represented by the gradation data is connected to the input terminal of the plurality of amplifiers 33. For example, in the first group switch circuit 91 to the fourth group switch circuit 94, the transmission gate that is indicated with gray is in the on state.

In the full operation mode indicated in FIG. 6B, the current control signals SD1 and SD2 are activated at a high level, the current control signals SD3 and SD4 are not activated at a low level, current flows in the gradation voltage generation circuits 61, 62, 71, and 72, and current does not flow in the gradation voltage generation circuits 63, 64, 73, and 74.

The control circuit 90 commonly controls the first group switch circuit 91 and the second group switch circuit 92 such that the gradation line corresponding to the gradation level that is represented by the gradation data is connected to the input terminal of the plurality of amplifiers 33. For example, in the first group switch circuit 91 and the second group switch circuit 92, the transmission gate that is indicated with gray is in the on state.

Meanwhile, the control circuit 90 forcibly sets the transmission gate of all of the third group switch circuit 93 and the fourth group switch circuit 94 to the off state. Thereby, it is possible to prevent crosstalk current flowing between the gradation voltage generation circuits 61 to 64 and 71 to 74 via the transmission gate.

The analysis circuit 23 indicated in FIG. 2 analyzes the gradation data DATA that is latched to the plurality of latch circuits 31, and reduces direct current that flows in at least one DAC 32 by stopping current flowing in at least one set within the gradation voltage generation circuits 61 to 64 and 71 to 74 according to the analysis result. A specific operation example of the display device according to the fifth embodiment will be described below.

FIRST OPERATION EXAMPLE

In the first operation example, the analysis circuit 23 determines whether or not the gradation level is the predetermined level or less of the gradation data for one line latched to the plurality of latch circuits 31. For example, when the first group data latch circuit 311*a* sequentially takes in the gradation data DATA in synchronization with the clock signal CLK, the analysis circuit 23 determines whether or not the gradation level represented by the gradation data DATA taken in to the first group data latch circuit 311*a* is the predetermined level or less concerning the gradation data for one line.

In a case where the gradation level of all pixels on one line is a predetermined level or less, the analysis circuit 23 activates a control signal SDAC in a period (for example, one horizontal synchronization period) in which the pixel circuit 11 of one line is driven based on the gradation data for one line. The control circuit 90 controls direct current in the plurality of DAC 32 according to the control signal SDAC. Thereby, in a case where the gradation level of all pixels on one line is a predetermined level or less, the analysis circuit 23 reduces direct current that flows in the plurality (L) of DAC 32 in a period in which the pixel circuit 11 of one line is driven based on the gradation data for one line.

In a case where the gradation level of all pixels in one line is a predetermined level or less, since the gradation level of the pixels is a black level or a low brightness level close to the black level, display unevenness and the like is difficult to visually recognize. Accordingly, it is possible to reduce the current consumption of the plurality of DAC 32 imparting almost no influence on image quality.

For example, in the DAC 32 indicated in FIG. 5, if the current control signals SD3 and SD4 are not activated at a low level while maintaining the current control signals SD1 and SD2 at a high level, it is possible to maintain the transistors QN61, QN62, QN71, and QN72 in the on state, set the transistors QN63, QN64, QN73, and QN74 to the off state, and set direct current to 1/2.

Alternatively, in the DAC 32 indicated in FIG. 5, if the current control signals SD2 to SD4 are not activated at a low level while maintaining the current control signal SD1 at a high level, it is possible to maintain the transistors QN61 and QN71 in the on state, set the transistors QN62 to QN64 and QN72 to QN74 to the off state, and set direct current to 1/4.

SECOND OPERATION EXAMPLE

In the second operation example, the analysis circuit 23 indicated in FIG. 2 determines whether or not the gradation level is the predetermined level or more of the gradation data for one line latched to the plurality of latch circuits 31. For example, when the first group data latch circuit 311*a* sequentially takes in the gradation data DATA in synchronization with the clock signal CLK, the analysis circuit 23 determines whether or not the gradation level represented by the gradation data DATA taken in to the first group data latch circuit 311*a* is the predetermined level or more concerning the gradation data for one line.

In a case where the gradation level of all pixels on one line is a predetermined level or more, the analysis circuit 23 activates a control signal SDAC in a period (for example, one horizontal synchronization period) in which the pixel circuit 11 of one line is driven based on the gradation data for one line. The control circuit 90 controls direct current in the plurality of DAC 32 according to the control signal SDAC. Thereby, in a case where the gradation level of all pixels on one line is a predetermined level or more, the analysis circuit 23 reduces direct current that flows in the plurality (L) of DAC 32 in a period in which the pixel circuit 11 of one line is driven based on the gradation data for one line.

In a case where the gradation level of all pixels in one line is a predetermined level or more, since the gradation level of the pixels is a white level or a high brightness level close to the white level, display unevenness and the like is difficult to visually recognize. Accordingly, it is possible to reduce the current consumption of the plurality of DAC 32 imparting almost no influence on image quality.

THIRD OPERATION EXAMPLE

In a third operation example, the analysis circuit 23 indicated in FIG. 2 activates the control signal SDAC in a blanking period. The control circuit 90 controls direct current in the plurality of DAC 32 according to the control signal SDAC. Thereby, the analysis circuit 23 reduces direct current that flows in the plurality of DAC 32 in the blanking period.

Since the gradation level is not a problem in the blanking period, it is possible to reduce the current consumption of the DAC 32 imparting almost no influence on image quality. For example, the analysis circuit 23 detects the blanking period based on the vertical synchronization signal and the horizontal synchronization signal that are supplied from the display control circuit 20.

According to the embodiments above, since the gradation data that is latched to the plurality of latch circuits 31 is analyzed and direct current that flows in at least one amplifier 33 or at least one DAC 32 is reduced according to an analysis result, it is possible to reduce current consumption of the amplifier 33 or the DAC 32 in the data line driving circuit 30 imparting almost no influence on image quality.

Electronic Apparatus

Next, an electronic apparatus which is provided with the display device according to any embodiment of the invention will be described. The display device 1 indicated in FIG. 1 is applied to performing high-definition display since the pixels have a small size, and as the electronic apparatus, a head mounted display is described as an example.

Figure 7:
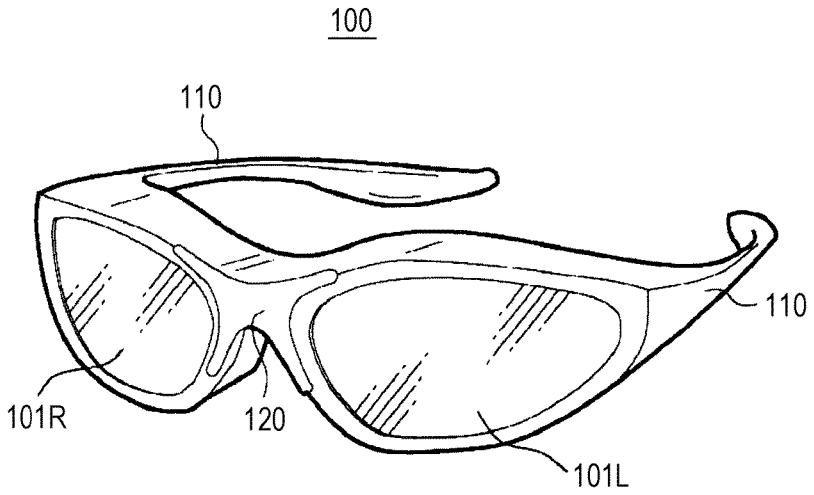
FIG. 7 is a perspective view illustrating an outer appearance of a head mounted display.
Figure 8:
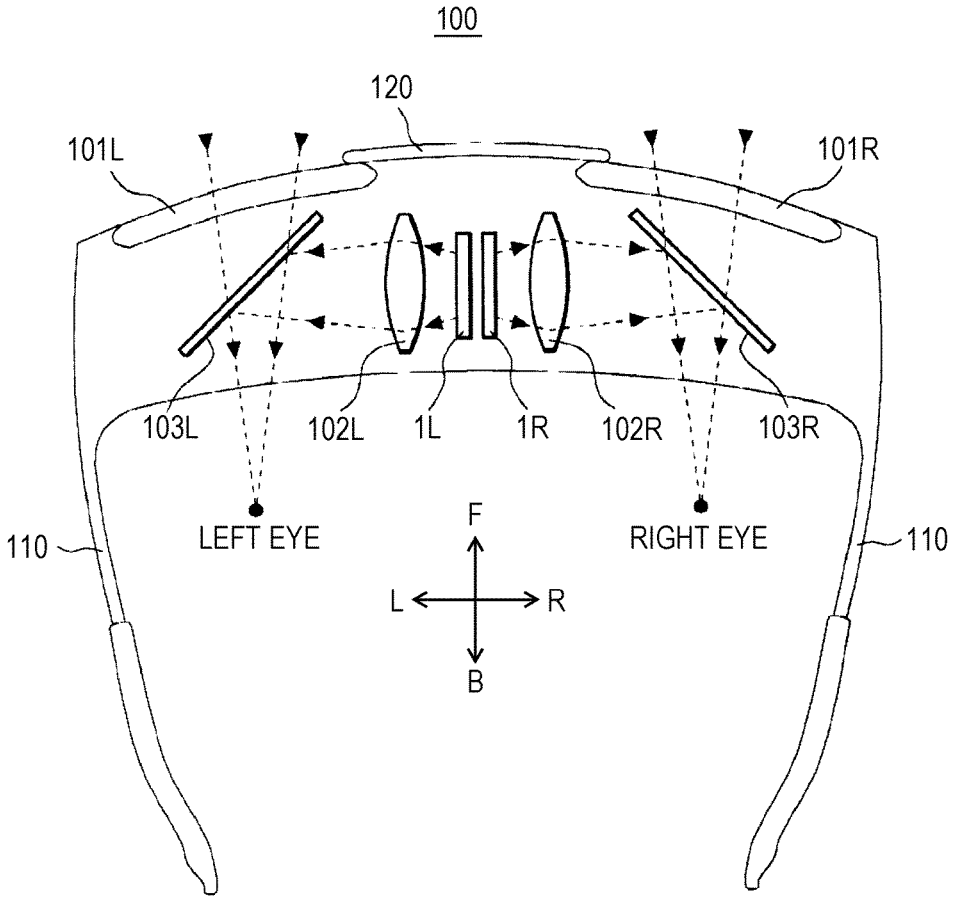
FIG. 8 is a planar view illustrating an optical configuration example of the head mounted display.

FIG. 7 is a perspective view illustrating an outer appearance of the head mounted display, and FIG. 8 is a planar view illustrating an optical configuration example of the head mounted display. As shown in FIG. 7, a head mounted display 100 is provided with a temple 110, a bridge 120, and lenses 101L and 101R in the same manner as general glasses. In addition, as shown in FIG. 8, in the head mounted display 100, a display device 1L for the left eye and a display device 1R for the right eye are provided on the far side (lower side in the drawing) of the lenses 101L and 101R in the vicinity of the bridge 120.

An image display screen of the display device 1L is disposed on the left side in FIG. 8. Thereby, a display image of the display device 1L is emitted in an L direction in the drawing via an optical lens 102L. Upon a half mirror 103L reflecting the display image of the display device 1L in a B direction in the drawing, light that is incident from an F direction in the drawing is transmitted.

An image display screen of the display device 1R is disposed on the right side in FIG. 8 conversely to the display device 1L. Thereby, a display image of the display device 1R is emitted in an R direction in the drawing via an optical lens 102R. Upon a half mirror 103R reflecting the display image of the display device 1R in the B direction in the drawing, light that is incident from the F direction in the drawing is transmitted.

By configuring in this manner, a user of the head mounted display 100 is able to observe the display image of the display devices 1L and 1R in a see-through state superimposed on the external landscape. In addition, in the head mounted display 100, a left eye image out of the both eye images associated with a parallax is displayed on the display device 1L, and it is possible for the user to perceive that there is a displayed image with depth and a three-dimensional effect (3D display) by displaying the right eye image on the display device 1R.

It is possible to apply the display device 1 indicated in FIG. 1 to an electronic apparatus such as an electronic viewfinder in a video camera or an interchangeable lens type digital camera other than the head mounted display 100. According to the embodiment, it is possible to reduce current consumption of the electronic apparatus using the display device in which current consumption of the amplifier or the D/A converter is reduced in the driving circuit imparting almost no influence on image quality.

In the embodiment, a case is described in which an OLED is used as the light-emitting element, but in the invention, for example, it is possible to use the light-emitting element that generates light at a brightness according to current such as an inorganic light-emitting diode or a light emitting diode (LED). In this manner, the invention is not limited to the embodiments described above, and various modifications are possible within the technical concept of the invention by a person who has general knowledge in the technical field.

The entire disclosure of Japanese Patent Application No. 2016-034098, filed Feb. 25, 2016 is expressly incorporated by reference herein.

What is claimed is:

1. A display device in which at least a display portion and a driving circuit are mounted on a same substrate, comprising:

a plurality of latch circuits which latch gradation data that is used to drive a plurality of data lines provided corresponding to a plurality of columns of a pixel circuit in the display portion;

a plurality of D/A converters which convert gradation data that is latched to the plurality of latch circuits to a plurality of analog signals;

a plurality of amplifiers which generate a plurality of gradation signals by respectively amplifying the plurality of analog signals output from the plurality of D/A converters; and an analysis circuit that analyzes gradation data that is latched to the plurality of latch circuits, determines whether a gray level of the gradation data is less than or equal to a predetermined level or higher than or equal to the predetermined level, the predetermined level being a single gray scale level different from a white level and a black level of the gradation data, and reduces direct current that flows in at least one amplifier or at least one D/A converter according to an analysis result.

2. The display device according to claim 1, wherein in a case where the analysis circuit determines whether or not a gradation level of gradation data for one line that is latched to the plurality of latch circuits is a predetermined level or less and a gradation level of all pixels of one line is a predetermined level or less, direct current that flows in the plurality of amplifiers or the plurality of D/A converters is reduced in a period in which the pixel circuit of one line is driven based on the gradation data for one line.

3. The display device according to claim 2, wherein when the analysis circuit reduces the direct current which flows in the plurality of amplifiers, potential of the plurality of data lines is controlled such that a driving transistor of the pixel circuit of one line that is driven based on the gradation data for one line is in a non-conductive state.

4. An electronic apparatus comprising:
the display device according to claim 3.
5. An electronic apparatus comprising:
the display device according to claim 2.
6. The display device according to claim 1,
wherein each of the plurality of D/A converters sequentially convert gradation data for one block to an analog signal for one block in a case where the plurality of data lines are separately driven in a plurality of blocks,
wherein each of the plurality of amplifiers amplifies the analog signal for one block sequentially output from the respective D/A converters and generates a gradation signal for one block, and
wherein a plurality of demultiplexers to which gradation signals for a plurality of blocks output from the plurality of amplifiers are respectively supplied and which performs a switching operation such that the gradation signal for each block is supplied to the predetermined number of data lines by time division, is further included.
7. The display device according to claim 6,
wherein in a case where the analysis circuit determines whether or not a gradation level of gradation data for one block that is latched to the plurality of latch circuits is a predetermined level or less and the gradation level of all pixels of one block is a predetermined level or less, direct current that flows in the amplifier that is connected to the D/A converter to which the gradation data for one block is supplied is reduced in a period in which the pixel circuit of one block is driven based on the gradation data for one block.
8. The display device according to claim 7,
wherein when the analysis circuit reduces direct current that flows in the amplifier, an output terminal of the amplifier is pulled up to a maximum potential of a gradation signal.
9. An electronic apparatus comprising:
the display device according to claim 8.
10. An electronic apparatus comprising:
the display device according to claim 7.
11. An electronic apparatus comprising:
the display device according to claim 6.
12. The display device according to claim 1,
wherein in a case where the analysis circuit determines whether or not a value of gradation data for one pixel that is supplied to each of the plurality of D/A converters is zero and the value of gradation data for one pixel is zero, the direct current that flows in the amplifier that is connected to the D/A converter to which the gradation data for one pixel is supplied is reduced in a period in which one pixel circuit is driven based on the gradation data for one pixel.
13. An electronic apparatus comprising:
the display device according to claim 12.
14. The display device according to claim 1,
wherein in a case where the analysis circuit determines whether or not a gradation level of gradation data for one line that is latched to the plurality of latch circuits is a predetermined level or more and a gradation level of all pixels of one line is a predetermined level or more, direct current that flows in the plurality of amplifiers or the plurality of D/A converters is reduced in a period in which the pixel circuit of the one line is driven based on the gradation data for one line.
15. An electronic apparatus comprising:
the display device according to claim 14.
16. The display device according to claim 1,
wherein the analysis circuit reduces direct current that flows in the plurality of D/A converters in a blanking period.
17. An electronic apparatus comprising:
the display device according to claim 16.
18. An electronic apparatus comprising:
the display device according to claim 1.

* * * * *